US006650865B2

(12) United States Patent
Quesnel

(10) Patent No.: US 6,650,865 B2
(45) Date of Patent: Nov. 18, 2003

(54) STALLED ROLL REGISTRATION SYSTEM AND METHOD EMPLOYING A BALL-ON-BELT INPUT TRANSPORT

(75) Inventor: Lisbeth S. Quesnel, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/042,337

(22) Filed: Jan. 11, 2002

(65) Prior Publication Data

US 2003/0133732 A1 Jul. 17, 2003

(51) Int. Cl.[7] ..... G03G 15/00
(52) U.S. Cl. ..... 399/388; 399/395
(58) Field of Search ..... 399/388, 394, 399/395

(56) References Cited

U.S. PATENT DOCUMENTS 3,256,009 A * 6/1966 Reilly ..... 271/246
4,487,407 A * 12/1984 Baldwin ..... 271/233
4,994,864 A * 2/1991 Schieck et al. ..... 399/395
5,078,384 A 1/1992 Moore ..... 271/228
5,156,391 A 10/1992 Roller ..... 271/227
5,202,738 A * 4/1993 Braswell et al. ..... 271/288 X
5,235,862 A 8/1993 Harada ..... 73/863.11
5,570,172 A * 10/1996 Acquaviva ..... 399/403
5,632,478 A 5/1997 Quesnel et al. ..... 271/242
5,775,690 A 7/1998 Quesnel et al. ..... 271/242

* cited by examiner

*Primary Examiner*—Fred L Braun
(74) *Attorney, Agent, or Firm*—William A. Henry II

(57) ABSTRACT

A stalled roll registration system and method includes a mechanism that allows for pivoting deskew action in a pre-registration nip. A ball-on-roll pre-registration transport is used in combination with a stalled roll registration nip. Any initial buckle is depleted rapidly as the body of a sheet straightens out at the registration nip under the influence of the ball-on-belt transport. The method includes the steps of providing a registration nip in a sheet path; providing a ball-on-belt sheet transport for directing a sheet towards the registration nip; feeding the sheet into the registration nip with the ball-on-belt transport; and then pivoting the sheet within the ball-on-belt transport in order to register the sheet against the registration nip.

11 Claims, 2 Drawing Sheets

STALLED ROLL REGISTRATION SYSTEM AND METHOD EMPLOYING A BALL-ON-BELT INPUT TRANSPORT

BACKGROUND OF THE INVENTION

1. Field of the Invention

This invention relates generally to a sheet registration device, and more particularly, to a pivoting deskew stalled roll registration system.

2. Description of Related Art

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, it is necessary to align and register the individual cut sheet so that the developed image is placed in the proper location on the sheet. Various schemes have been developed to assure that the image-receiving sheet is in the proper location and forwarded at the proper time. Some complex printing machines utilize various sensors and translating nips to align the sheet in the proper position for receiving the image. Other machines utilize variable speed stepping motors to differentially drive a sheet within a sheet path for deskew and registration purposes. Both of these registration methods require sophisticated control and are relatively high cost.

Another method for registering and aligning a sheet is the use of stalled rolls. In the stalled roll technique, a sheet is driven into a nip in which the rolls are stopped causing a buckle to be formed between the stalled roll and the driving rolls. The force of the buckle causes the lead edge of the sheet to align itself within the stalled nip and the stalled nip is then activated so that the sheet is forwarded in the proper aligned position. Other systems utilize a stall roll with a solenoid actuated drive nip in which the drive nip precedes the stalled roll so that the sheet is free to deskew in the stalled nip. While simpler than the active registrations described previously, the stalled roll technique with solenoid actuated nip still requires a solenoid to deactivate the drive nip. Other problems arise if the buckle in a stalled roll system gets too large which can then cause the registration force to decrease and the lead edge of the sheet to back out of the nip causing skew.

It is desirable to have a stalled roll registration device in which a sheet could be deskewed and registered within the stalled nip and then secured prior to being forwarded in timed registration to a subsequent machine subsystem.

In U.S. Pat. No. 5,235,862 to Acquaviva et al., issued Oct. 19, 1993 a sheet handler is disclosed that includes an idler and driven cross roller set. The rollers are preloaded so that a normal force exists between the rollers at the nip. The nip is provided with an apparatus for adjusting the preloaded force to adjust the normal force on the sheet material passing through the nip.

A method and apparatus for deskewing and registering a sheet in a short paper path is shown in U.S. Pat. No. 5,156,391 issued Oct. 20, 1992 to Roller, by differentially driving two sets of rolls so as to create a paper buckle buffer zone in the sheet and then differentially driving a roll set to correct skew while the sheet is still within the nips of multiple drive roll sets.

U.S. Pat. No. 5,078,384 issued Jan. 7, 1992 to Moore discloses a method and apparatus for deskewing and registering a sheet, including the use of two or more selectably controllable drive rolls operating in conjunction with sheet skew and lead edge sensors for frictionally driving and deskewing sheets having variable lengths. Sheets will be advanced to reach a predetermined registration position at a predetermined velocity and time at which time the sheets will no longer be frictionally engaged by the drive rolls.

A two step optimized stalled roll registration and deskew system is shown in U.S. Pat. No. 5,775,690 issued Jul. 7, 1998 that includes a drive mechanism preceding a stalled roll pair and a sensor to determine the size of a buckle formed in a sheet as it is fed into the registration nip formed by the stalled roll pair. When the buckle reaches a predetermined size the sensor generates a signal which causes the drive controller to briefly pulse the registration roll pair. This brief pulse of the registration roll pair captures the sheet in the nip in a deskew and registered position for subsequent feeding in a timed relationship to a machine subsystem. A baffle located between the drive nip and registration nip directs the sheet buckle formation in a controlled manner so that proper deskewing and registration forces are obtained.

U.S. Pat. No. 5,632,478, issued May 27, 1997 to Lisbeth S. Quesnel describes a stalled roll registration device in which there is provided a drive mechanism preceding the stalled roll which allows a sheet to move while within the drive nip. The drive mechanism uses a drive roll and an eccentric idler roll in contact therewith. The idler is biased against the drive roll by a compression spring such that as the eccentric idler roll rotates, the spring is alternately compressed and relaxed. When a sheet is driven through the drive mechanism and into the stalled nip, a buckle is formed which causes a force to be exerted on the drive nip, which causes the eccentric roll to stall in the horizontal position in which little normal force is exerted on the sheet. The sheet is then free to deskew and align in the stalled nip.

Even though the above-mentioned registration and deskewing systems are useful, there is still a need to remove large amounts of sheet input skew that cannot be removed by the standard stalled roll system.

SUMMARY OF THE INVENTION

Accordingly, pursuant to the features of the present invention, an improved stalled roll registration and deskew system is disclosed that answers the above-mentioned problem by providing a hard roller registration nip in conjunction with a ball-on-belt sheet transport. The ball-on-belt transport facilitates rotational movement of a sheet against the registration nip as the sheet is driven into the nip.

These and other features and advantages of the invention are described in or apparent from the following detailed description of the exemplary embodiments.

BRIEF DESCRIPTION OF THE DRAWINGS

The foregoing and other features of the instant invention will be apparent and easily understood from a further reading of the specification, claims and by reference to the accompanying drawings in which like reference numerals refer to like elements and wherein:

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
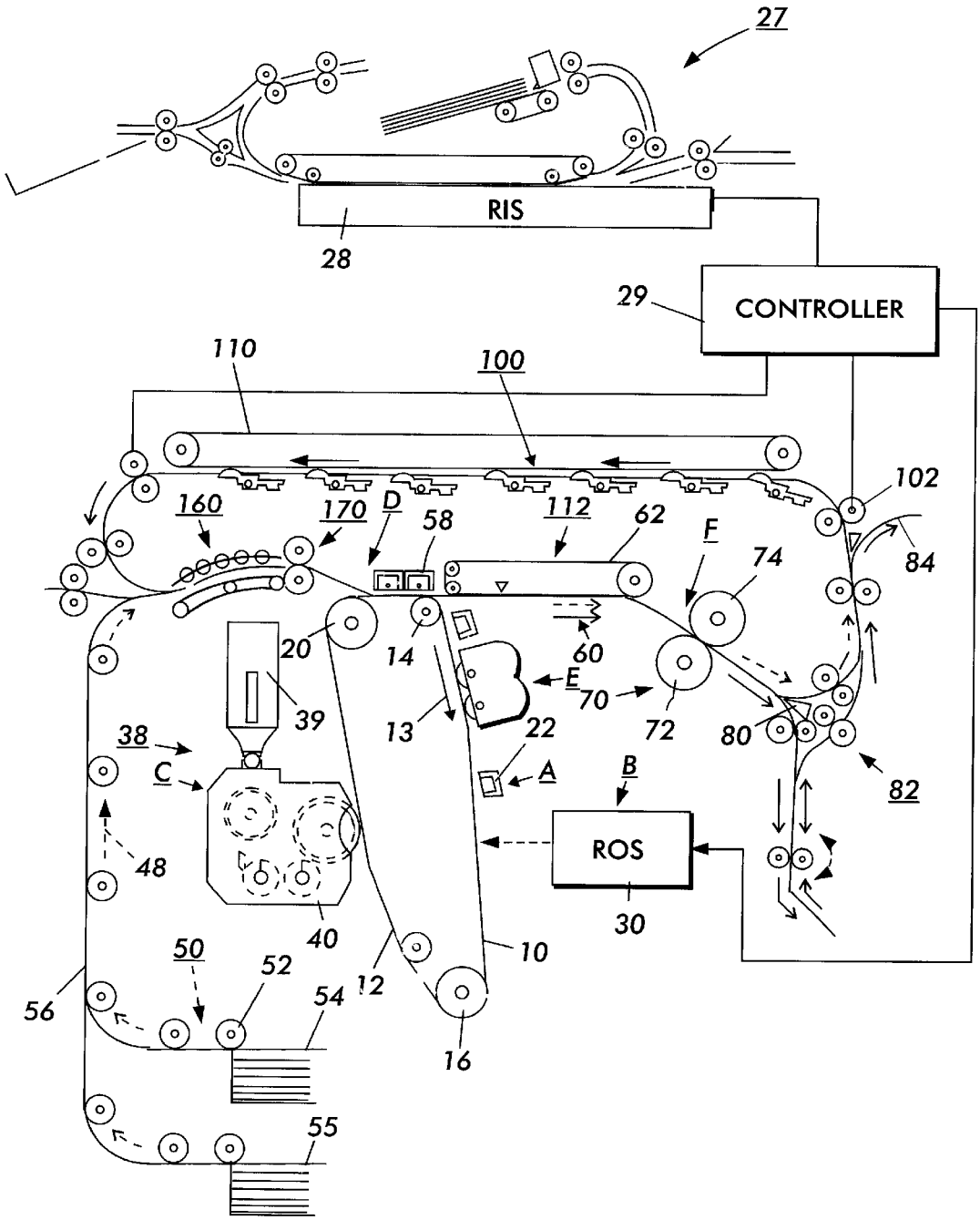
FIG. 1 is a schematic elevational view of a typical electrophotographic printing machine utilizing the sheet deskew and registration device of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the stalled roll registration device of the present invention may be employed in wide variety of devices and is not specifically limited in its application to the particular embodiment depicted herein.

FIG. 1 illustrates an original document positioned in a document handler 27 on a raster input scanner (RIS) indicated generally by the reference numeral 28. The RIS contains document illumination lamps; optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine, which generally employs a photoconductive belt 10. Preferably, the photoconductive belt 10 is made from a photoconductive material coated on a grounded layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photocondctive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example a raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by raster basis.

After the electrostatic latent image has been recorded on photoconductive surface 12, belt 10 advances the latent image to a development station, C, where toner, in the form of liquid or dry particles, is electrostatically attracted the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 160 past image transfer station D to receive an image from photoreceptor belt 10 In a timed sequence so that the toner powder image formed thereon contacts the advancing sheet 48 at transfer station D. Transfer station D includes a corona generating device 58, which sprays ions onto the back side of sheet 48. This attracts the toner powder image from photoconductive surface 12 to sheet 48. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roll 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 62 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor, which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
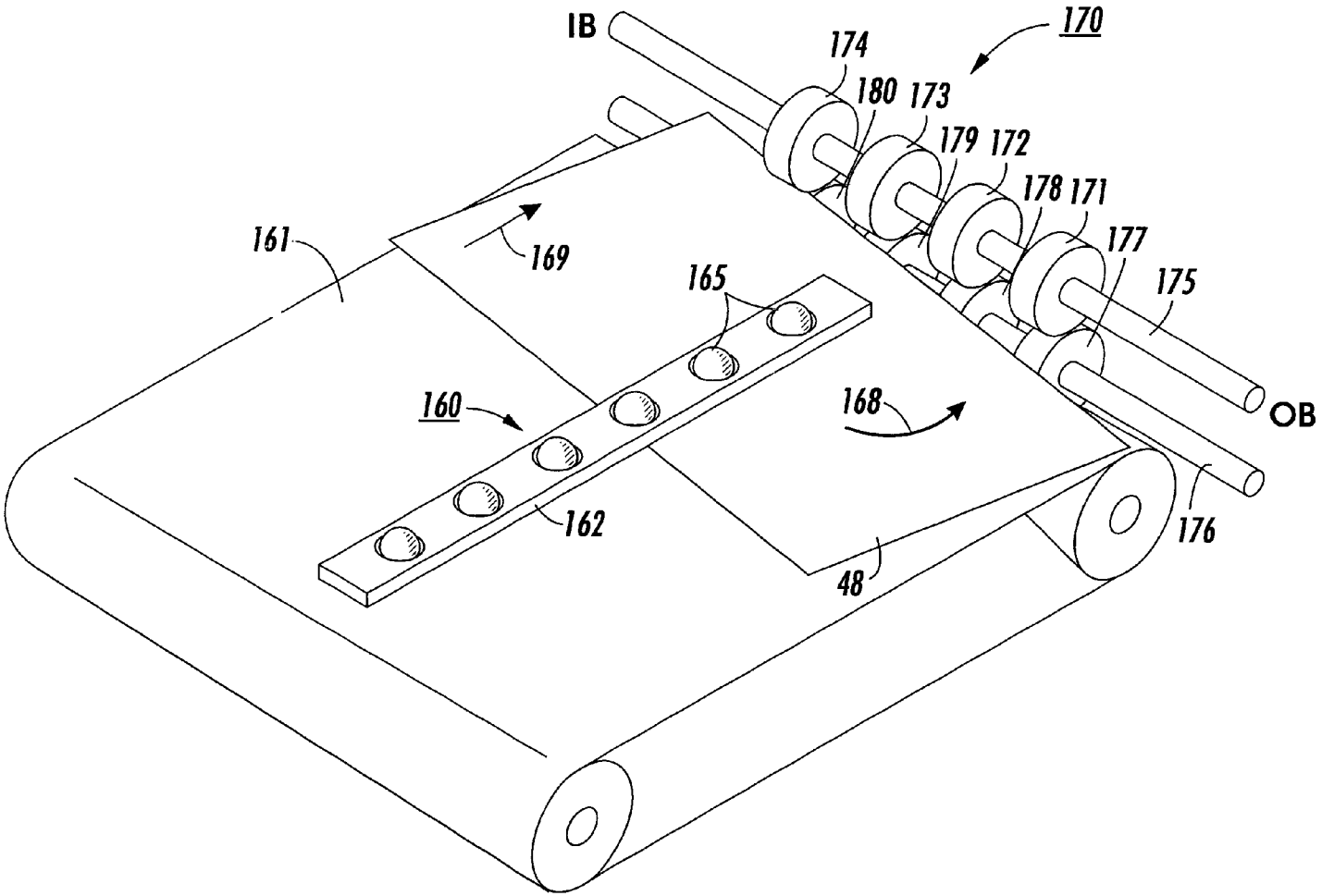
FIG. 2 is a partial schematic plan illustration of the deskew stalled roll registration system in FIG. 1 employing a ball-on-belt transport in accordance with an aspect of the present invention.

In accordance with an aspect of the present invention as shown in FIG. 2, an improved stalled roil pivoting deskew registration system comprises a stalled nip at registration in combination with a low cost rotationally compliant ball-on-belt input transport. A stalled registration nip represented by 170 is formed between drive rollers 171, 172, 173 and 174 mounted on shaft 175 and idler rollers 177, 178, 179 and 180 mounted on shaft 176. As viewed in FIG. 2, the inboard end of the stalled roll registration device is shown as (IB) and the outboard end is shown as (OB). Ball-on-belt transport 160 includes a belt 161 positioned below balls 165 supported by frame 162. Ball-on-belt transport 160 simultaneously provides forward drive while allowing the trailing body of sheet 48 to move and deskew in accordance with what is happening at the lead edge of the sheet. Sheet 48 is moving at a predetermined velocity in the direction of arrow 169. The sequence of events is as follows: When the lead edge of sheet 48 contacts the nip 170, the sheet maintains a flat attitude, i.e., does not buckle out of plane and rotates into a deskewed position. This is made possible by a slip and slide forward motion of sheet 48 under predetermined light normal forces exerted by balls 165.

As shown in FIG. 2, arrow 168 shows the pivot direction of sheet 48 once the lead edge of the sheet contacts stalled registration nip 170. The sheet straightens out under ball-on-belt transport 160 as it continues to be fed into the stalled registration nip 170. Sheet 48 is allowed to move around in a counterclockwise direction due to the lightness of forces on ball-on-belt transport 160.

While ball-on-belt transport 160 is shown in use on a mostly horizontal plane, it can be incorporated into a vertical transport by varying the normal force to the extent required on the belt transport. Low cost ball-on-belt transport 160 can also be used as a duplex and/or vertical transport of side 1 sheets from a cassette feeder, if desired. Even though only one ball-on-belt mechanism is shown in FIG. 2, it should be understood that multiple ball-on-belt mechanisms could be used, if necessary.

It should now be understood that an improvement to stalled roll registration systems has been disclosed which uses a ball-on-belt transport as the pre-registration transport. Any initial buckle is depleted rapidly as the body of the sheet straightens out under the influence of the ball-on-belt transport. Because the ball-on-belt transport allows the sheet to slip and rotate, large amounts of input skew can be removed by this mechanism.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. An apparatus for registering a sheet in a path, comprising:

a stalled roll registration nip located in the path, said stalled roll registration nip being adapted to feed a registered sheet downstream for further processing; and a rotationally compliant input pre-registration transport, and wherein said rotationally compliant input pre-registration transport drives the shoot in a forward direction directly into said stalled roll registration nip and includes at least one ball-on-belt nip that facilitates sheet pivoting therein and is adapted to register a sheet against said stalled roll registration nip without causing a buckle at said stalled roll registration nip.

2. The apparatus of claim 1, wherein said ball-on-belt nip includes at least one belt and at least one idler roll.

3. The apparatus of claim 2, wherein said stalled roll registration nip is formed by at least one drive roll and at least one idler roll positioned in contacting relation thereto.

4. The apparatus of claim 3, wherein said rotationally compliant input pre-registration transport includes a plurality of ball-on-belt nips.

5. The apparatus of claim 1, wherein said rotationally compliant input pre-registration transport includes at least one belt.

6. A printing machine in which a sheet is driven along a path and fed in a timed relationship and registration position to a process station, comprising:

a stalled roll registration nip located in the path; and a ball-on-belt input transport that simultaneously drives a lead edge of a sheet in a forward direction while allowing the trailing body of the sheet to move and deskew in accordance with what is happening at the lead edge of the sheet without causing a buckle at said stalled roll registration nip.

7. The printing machine of claim 6, wherein said ball-on-belt input transport includes at least one nip comprising a belt and a ball.

8. The printing machine of claim 7, wherein said stalled roll registration nip is formed by at least one drive roll and at least one idler roll positioned in contacting relation thereto.

9. The printing machine of claim 8, wherein said ball-on-belt input transport includes multiple ball on belt nips.

10. The printing machine of claim 9, wherein said ball-on-belt transport includes at least one belt.

11. A method for registering a sheet transported in a path to a downstream registration location, comprising:

providing a stalled roll registration nip located in the path;

providing a ball-on-belt input transport;

feeding a sheet in a forward direction into said stalled roll registration nip with said ball-on-belt transport without causing a buckle at said stalled roll registration nip; and pivoting the sheet within said ball-on-belt transport in order to register the sheet against said stalled roll registration nip.

* * * * *